US005326185A

United States Patent [19]

Dornbusch et al.

[11] Patent Number: 5,326,185

[45] Date of Patent: Jul. 5, 1994

[54] LOW COST FILL/INVERT SAMPLE SIZE PACKAGE FOR A COSMETIC STICK FORM PRODUCT

[75] Inventors: Arthur H. Dornbusch, Cincinnati; Marcus W. Greenwald, Loveland; John J. Rego, Avon Lake, all of Ohio

[73] Assignee: The Procter & Gamble Company, Cincinnati, Ohio

[21] Appl. No.: 938,904

[22] Filed: Aug. 31, 1992

[51] Int. Cl.[5] ..... A45D 40/00; A45D 40/16

[52] U.S. Cl. ..... 401/88; 401/98

[58] Field of Search ..... 401/88, 98

[56] References Cited

U.S. PATENT DOCUMENTS

| | | | |
|---|---|---|---|
| 954,211 | 4/1910 | Rote . | |
| 1,283,307 | 10/1918 | Rich | 401/98 X |
| 1,357,026 | 10/1920 | Brown | 401/98 |
| 1,742,728 | 1/1930 | Reutter . | |
| 2,349,800 | 5/1944 | Lee | 206/56 |
| 2,942,577 | 6/1960 | Solow | 120/83 |
| 3,332,429 | 7/1967 | Bates | 132/79 |
| 4,139,311 | 2/1979 | Lorscheidt | 401/55 |
| 4,208,143 | 6/1980 | Nored | 401/98 |
| 4,235,557 | 11/1980 | Hayes | 401/49 |
| 4,369,158 | 1/1983 | Woodruff et al. | 264/268 |
| 4,621,935 | 11/1986 | Sussman | 401/82 |
| 4,728,210 | 3/1988 | Barish et al. | 401/6 |
| 4,915,234 | 4/1990 | Boeller | 401/98 X |
| 4,950,094 | 8/1990 | Yorks | 401/75 |
| 5,092,700 | 3/1992 | Susini | 401/98 |

FOREIGN PATENT DOCUMENTS

| | | | |
|---|---|---|---|
| 515740 | 4/1921 | France | 401/98 |
| 634375 | 2/1928 | France | 401/98 |
| 915422 | 11/1946 | France | 401/98 |
| 2565559 | 12/1985 | France | 401/98 |
| 134624 | 11/1919 | United Kingdom | 401/98 |
| 2162822A | 2/1986 | United Kingdom . | |

*Primary Examiner*—Steven A. Bratlie
*Attorney, Agent, or Firm*—Dean L. Garner

[57] ABSTRACT

A sample/trial size package for cosmetic stick-form products, such as deodorants. The package is especially adapted for use with the fill/invert method of manufacture. The product is secured within the package in a fixed position throughout its use. The package has a base for holding the product. The base comprises an enclosed body, a closed bottom and an open top. The base further includes a stalk axially oriented within it. The stalk defines a trough along the inside perimeter of the base between the stalk and the body. Lastly, the package has a cap for sealing the open top of the base when the package is not in use.

10 Claims, 5 Drawing Sheets

LOW COST FILL/INVERT SAMPLE SIZE PACKAGE FOR A COSMETIC STICK FORM PRODUCT

FIELD OF THE INVENTION

The present invention relates to packages for stick-form cosmetic products. The present invention has further relation to such packages which are specially adapted for use with the fill/invert process of manufacture. More particularly, the present invention relates to such packages that are designed to have a limited use so as to be a sample or trial size package.

BACKGROUND OF THE INVENTION

In the design and manufacture of deodorant or anti-perspirant stick products it is preferable that the top of the stick have a convex contour and that its cross-sectional shape be circular or oval. The convex shape is desired so that the product is comfortable to apply upon its first application and has a good appearance to the consumer. The oval cross-section makes the application more efficient by requiring a minimum number of strokes to apply the product evenly. Such packages are typically equipped with an elevator screw dispensing system wherein an elevator platform is disposed within the package at its bottom end and has a spindle in threaded engagement therewith. A hand wheel to turn the spindle is located outside the bottom of the package for use by the consumer in advancing and retracting the product.

One method of manufacturing such products is known as the bottom fill method. The desired shape of the stick product is generally achieved by providing a package having an oval or circular cross-section and a cap, factory seal or puck of the same cross-section on the top of the package. The cap/puck/seal has a smooth concave inner surface which is adapted to function as a mold in forming the top of the stick. The product is poured into the package in its molten state through the bottom. While the product is still in the molten or liquid form the elevator/screw system is inserted into the package and the bottom of the container is sealed. The product and package are then allowed to cool whereby the shape of the package and the cap cause the product to take on the desired appearance. An example of a cosmetic stick-type dispensing package especially adapted for use with the bottom fill manufacturing method can be found in U.S. Pat. No. 4,369,158 issued to Woodruff et al. on Jan. 18, 1983.

Another and more preferable method used to manufacture stick-type cosmetic products is known as the fill/invert method. This method produces a product with the desired shape by providing a package having an oval or circular cross-section but with a closed bottom. The package has the elevator/screw dispensing system disposed therein before filling. The product is poured into the package through the top and the top of the package is then sealed with a factory seal or a puck having a smooth concave inner surface for molding the end of the stick. The package is thereafter inverted so that some of the molten product flows from the bottom of the package to the top to fill the outage volume, which is the volume intermediate the original fill line and the factory seal or puck. The package is then kept in this position during cooling. An example of a package especially adapted for use with the fill/invert manufacturing process is described in co-pending and commonly assigned U.S. application Ser. No. 760,661 filed in the names of Dornbusch et al. on Sep. 16, 1991 the disclosure of which is hereby incorporated herein by reference.

Recently, there has been a desire to make a sample/-trial size or limited use package for cosmetic stick form products. A limited use, sample size or trial size package is typically one that is designed for less than 25 applications of product. One method of of producing such packages is to make a smaller size version of either of the packages described above. However, the elevator/-screw dispensing systems present in such packages make this impractical as it would cause the sample size package to have too many parts and, therefore, be too expensive. Because limited use sample or trial size packages are often made available to the consumer at little or no cost it is preferable to produce them relatively cheaply. Therefore, there has been a desire to make a low cost sample size package for a cosmetic stick form product that does not need an elevator screw dispensing system or any type of advancing means for the product within the package.

Cosmetic stick form packages have been made in the past that do not require an advancing means for the product within the package. An example of such a package is described in U.S. Pat. No. 4,728,210 issued to Barrish et al. oil Mar. 1, 1988. This reference discloses a solid personal care product that is packaged in a container having a cover and a handle. All of the product extends above the handle and the cap is big enough to cover all of the product when the package is not in use. Therefore, this package requires no advancing means. Another package similar to Barish et al. that requires no advancing means is described in U.S. Pat. No. 4,235,557 issued to Hayes on Nov. 25, 1980. However, both of the packages disclosed in the above mentioned references are bottom fill packages which require that the bottom of the package be sealed after filling. This procedure would add expense to a sample size product.

Furthermore, because the cosmetic products in such packages are often composed of a large proportion of volatile materials such as alcohol, it is necessary to seal the package thoroughly prior to use by consumers in order to prevent the escape of these materials during manufacture, shipment and storage. When the package is not effectively sealed, volatiles evaporate and the product shrinks losing its shape, fragrance and aesthetic appearance. The major problem of sealing the bottom fill packages has been to provide an effective sealing means on the bottom of the package after the package has been filled. In bottom fill packages, the bottom wall is not integral with the package but must be attached after filling. The base must be sealed to the side walls in order to prevent the escape of volatiles therefrom. Because the fill/invert packages have the bottom wall integral with the base of the package to provide better sealing, it is the preferred method for manufacturing cosmetic stick-form products.

It is therefore an object of the present invention to provide a low cost limited use package for a cosmetic stick form product that is adapted for use with the fill-/invert process of manufacture.

It is another object of the present invention to provide such a package that requires no advancing means within the product in order to eliminate the costs associated therewith.

The aforementioned and other objects of the present invention will become more apparent hereinafter.

SUMMARY OF THE INVENTION

In accordance with the present invention there is provided a limited use fill/invert package for a solid stick-form product. The package is such that the product is secured within it in a fixed position throughout its use. The package comprises a base for holding the solid stick-form product. The base has an enclosed body, a closed bottom and an open top. A stalk is axially oriented within the base and secured within the base adjacent its bottom. The base further includes a trough along the inside perimeter of the base between the stalk and the body of the base. The package is further provided with a cap for sealing the open top of the base when the package is not in use. The package is such that whenever the cap is removed the useable product is in its fully exposed condition for application.

BRIEF DESCRIPTION OF THE DRAWINGS

While the specification concludes with claims particularly pointing out and distinctly claiming the subject invention, it is believed that the same will be better understood from the following description when taken in conjunction with the accompanying drawings in which:

DETAILED DESCRIPTION OF THE INVENTION

Figure 1B:
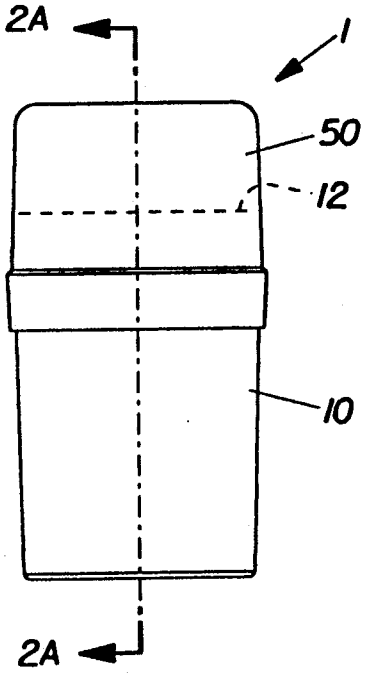
FIG. 1B is a plan view of the side of package shown in FIG. 1A.
Figure 1A:
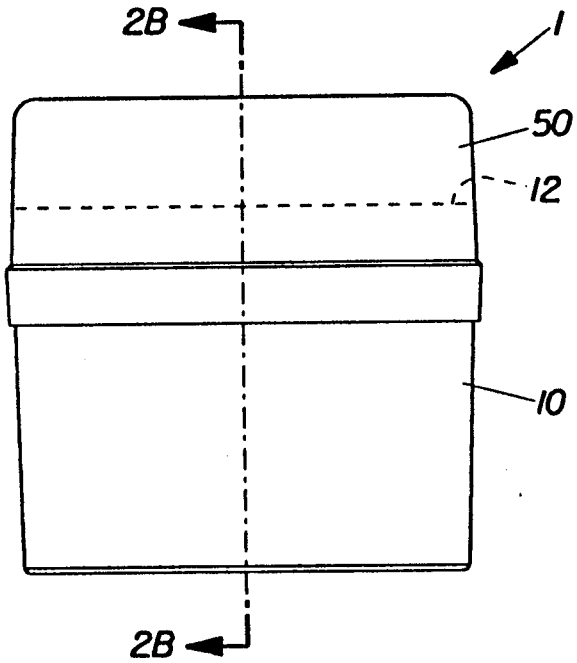
FIG. 1A is a plan view of the front of package of the present invention.
Figure 2B:
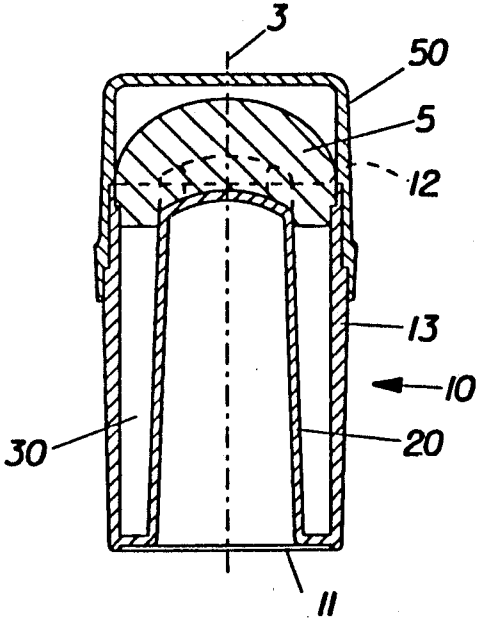
FIG. 2B is a sectional view of the package of FIG. 1A taken along line 2B—2B of FIG. 1A.
Figure 2A:
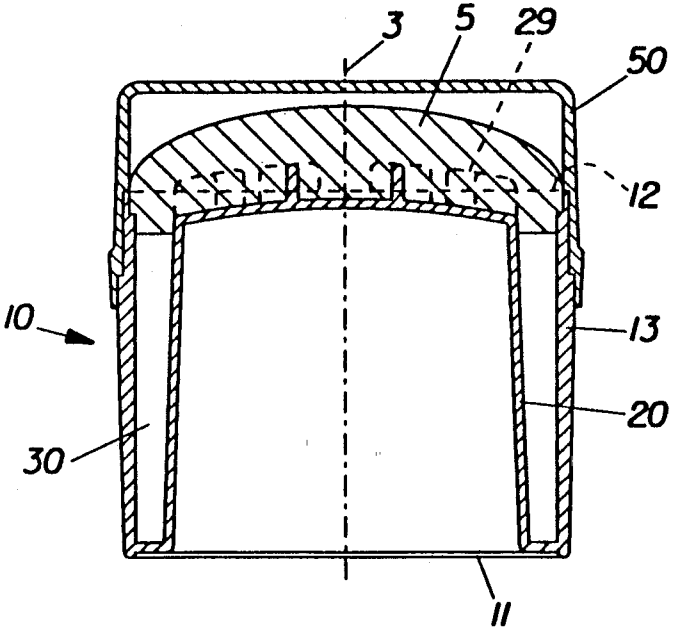
FIG. 2A is a sectional view of the package of FIG. 1B taken along line 2A—2A of FIG. 1B.

Referring to the drawings in detail wherein like numerals indicate the same element throughout the view there is shown in FIG. 1 a limited use fill/invert package for a cosmetic stick-form product 5, such as an antiperspirant or deodorant. The package has a base 10 and cap 50. The component parts of the package can be better understood by referring to FIGS. 2A and 2B where there is shown sectional views of FIGS. 1A and 1B taken along lines 2—2. The base 10 has an enclosed body portion 13, a closed bottom 11 and open top 12. The base further includes a stalk 20 axially oriented within the base and secured within the base adjacent its bottom 11. The top 29 of the stalk 20 preferably has a domed or convex shape as shown in FIG. 2A in order to provide comfort at the end of use cycle of the package. The stalk 20 defines a trough 30 along the inside perimeter of the base 10 between the stalk 20 and the body 13. The cap 50 is provided for sealing the open top 12 of the base 10 when the package is not in use. It is preferred that the base 10 have an oval cross-section when taken perpendicular to its longitudinal axis 3 running from top 12 to bottom 11.

In a preferred embodiment the base 10 is of one piece construction molded from polypropylene. The cap 50 is also preferably of one piece construction made from polypropylene. Various manufacturing techniques known in the art can be used to manufacture the base 10 and cap 50, including injection molding.

Figure 3B:
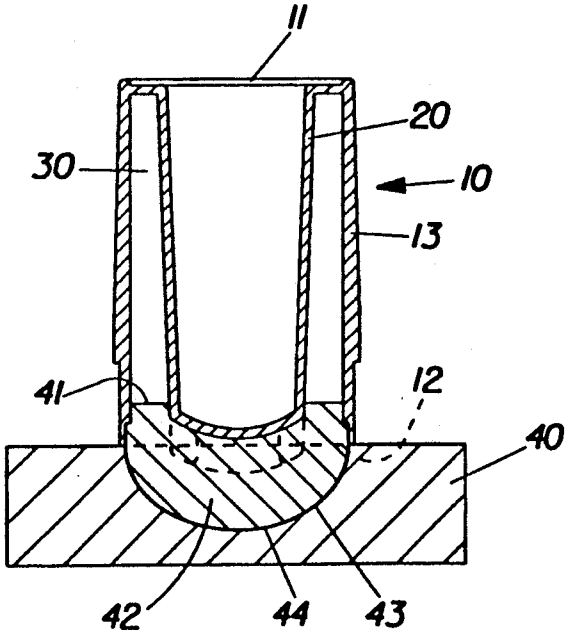
FIG. 3B is a similar view to FIG. 3A but with a puck 40 sealing the top and the package in its inverted position.
Figure 3A:
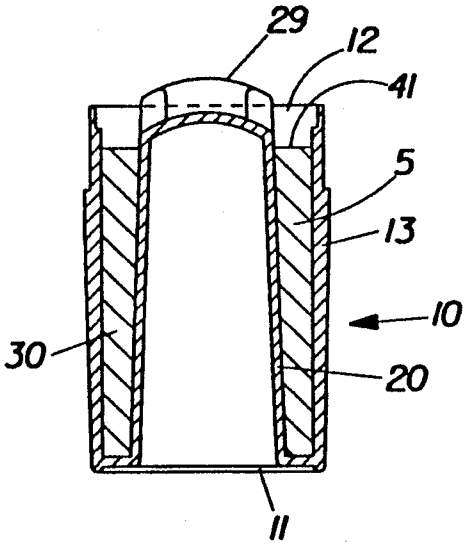
FIG. 3A is a similar view to FIG. 2B but with the cap 50 removed and showing how the package would appear when it is filled with molten product.

In order to better understand various preferred features of the package it will be helpful to explain the manufacturing process in which the package 1 is adapted to be used with. The fill/invert method that is used to form the product 5 within the base 10 can best be described by referring to FIGS. 3A and 3B. FIG. 3A is a view similar to FIG. 2B but with the cap 50 removed and the product 5 poured in the base 10 when its in its liquid or molten state. Product is poured through the open top 12 of base 10 and filled up to a predetermined fill line 41. A puck 40, preferably having a smooth concave inner surface 43, is then placed over the open top 12 of base 10. The package is then inverted as shown in FIG. 3B. When the package is inverted, the product being in its molten state flows from the bottom of trough 30 in order to fill the space between the top 12 and the puck 40. The product and package are then cooled so that the product 5 hardens and takes on the shape of the inner surface 43 of puck 40.

As seen from FIGS. 3A and 3B the volumetric capacity of the trough 30 should be at least as great as the head space volume obtained during manufacture. The head space volume 42 is herein defined as the volume between the top 12 of base 10 and the inner surface 43 of puck 40. If the volumetric capacity of the trough is below that of the head space volume then when the package is inverted all of the product will remain in the puck and none would left to adhere the product to the base 10.

After the product has cooled and hardened the puck 40 is removed and the cap 50 is placed on the package. In an alternative embodiment, however, the cap 50 can be provided with a smooth concave inner surface, similar to the puck's, and used in place of the puck. This embodiment eliminates the extra manufacturing steps of removing the puck and then putting on the cap.

As seen from the Figures the package 1 has no advancing means for the stick-form product 5. The package is designed to be used only a limited number of times and all of the usable product that is to be used throughout the life of the package extends above the top 12 of base 10. The package is then such that whenever the cap is removed the usable product is in its fully exposed condition for application.

Figure 4:
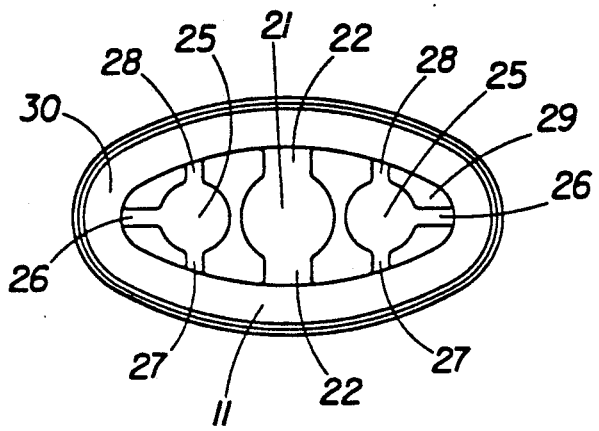
FIG. 4 is a top plan view of the base 10 of a package of the present invention.

The stalk 20 has many features which help aid in the fill and invert method described above and which also aid in adhering the product 5 to the base 10. The top 29 of stalk 20 can best be described by referring to FIG. 4 where there is shown a top view of the base 10. The top 29 of stalk 20 has three substantially cylindrical indentations. A center indentation 21 and two side indentations 25. The center indentation is most likely where the molten product will be poured into the base 10. Therefore, it is preferred that the depth of indentation 21 be below the top 12 of base 10 to decrease the chances of spilling and splashing during the filling operation. The center indentation has two runners 22 that lead off the cylindrical indentation from front to back. The bottom of the runners are smoothed and curved at their bottom in order to assist in the easy flow of product from indentation 21 into the trough 30 during the filling operation. The side indentations 25 are generally smaller than the central indentation 21. These indentations have three runners 26, 27 and 28. Each runner is angled toward the bottom of the base 11. These runners allow the air that is trapped between the fill line and the top of the puck, before inversion, to escape to the trough when the package is inverted after filling. The three indentations also help adhere the product 5 to the base 10. In addition, in a preferred embodiment the arc 29 of stalk 20 is tangent to the top 12 of base 10 for smooth applications.

Figure 5:
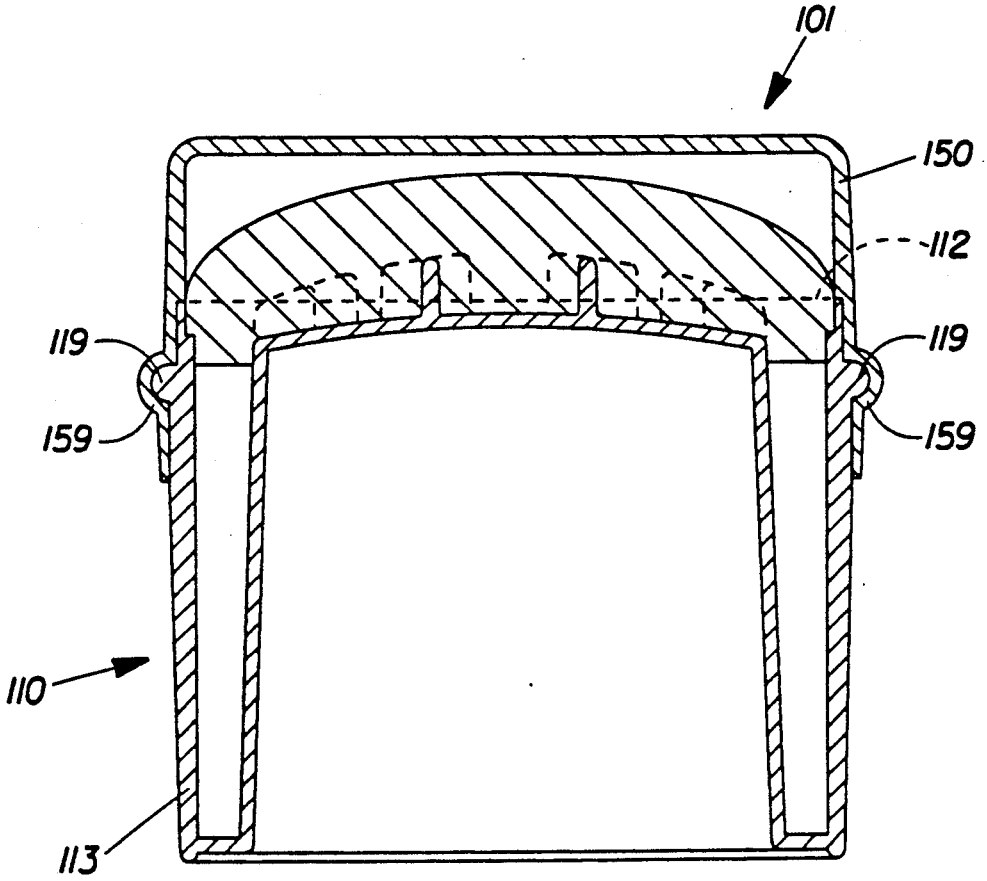
FIG. 5 is a view similar to FIG. 2A, but of an alternative embodiment of the package of the present invention.

The cap 50 preferably includes a means to secure the cap 50 to base 10. This is so that the cap will not become easily detached from the base during transportation. Although many ways of securing the cap to the base will be known by those skilled in the art, a particularly preferred embodiment for this can best be explained by referring to FIG. 5 where there is shown a cross-sectional view, similar to FIG. 2A, of an alternative embodiment 101 of the package of the present invention. Package 101 has cap 150 and base 110. Base 110 has annular bead 119 along its outer perimeter adjacent its top 112. Cap 150 has annular indentation 159 along its perimeter. Annular indentation 159 is designed to snap-fit over annular bead 119 to better secure cap 150 to base 110.

In an additional embodiment the package can be provided with a means for releasably securing multiple packages on top of one another. For example the bottom 11 of the base 10 could be provided with a means for releasably securing itself to the top of the cap of an identical package. Similarly, the top of the cap 50 could be provided with a means to releasably secure itself to the bottom of an identical package. Both the top of the cap 50 and the bottom 11 of the base could be provided with cooperating means for releasably securing multiple packages together. One advantage to this design is that if the product 5 came in different odors or the like, consumers could mix and match the different products as they wanted.

While particular embodiments of the present invention have been illustrated and described various modifications will be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A sample size limited use fill/invert package having a solid stick form product therein, wherein said product is secured within said package in a fixed position throughout its use, said package comprising:

(a) a base holding said stick form product, said base having an enclosed body, a closed bottom and an open top, said stick form product having a substantially convex outer surface projecting from said open top of said base, said base further including a stalk axially oriented within said base and secured within said base adjacent said bottom, said stalk having a means, adjacent said top of said base, for securing said stick form product within said base, said base further including a trough along the inside perimeter of said base between said stalk and said body, said trough being substantially free of said stick form product at points adjacent said bottom of said base; and (b) a cap for sealing said open top of said base when said package is not in use, whereby whenever said cap is removed the usable portion of said product is in its fully exposed condition for application.

2. The package according to claim 1 wherein said stalk has a domed, convex top.

3. The package according to claim 2 wherein the arc of said dome is tangent to the top edge of said base.

4. The package according to claim 1 wherein said means for securing said product within said base comprises one or more indentations disposed on the top of said stalk.

5. The package according to claim 1 wherein said stalk has a means to allow air trapped in said package before inversion to escape to the bottom of the trough during inversion.

6. The package according to claim 5 wherein said means comprises indented runners extending from the top of said stalk to its outermost edge.

7. The package according to claim 1 further including a means to secure said cap to said base.

8. The package according to claim 7 wherein said means to secure said cap to said base comprises an annular bead on said base adjacent its top, said bead adapted to snap-fit into an annular indentation disposed on said cap.

9. The package according to claim 1 wherein said base is of one piece construction.

10. The package according to claim 1 wherein said base has an oval cross-section when taken perpendicular to its longitudinal axis running from said top to said bottom.

* * * * *